United States Patent [19]

Uher

[11] Patent Number: 5,046,143

[45] Date of Patent: Sep. 3, 1991

[54] SWITCH ACTUATING EXTENSION

[76] Inventor: Roy A. Uher, 6444 W. 112th St., Worth, Ill. 60482

[21] Appl. No.: 535,576

[22] Filed: Jun. 11, 1990

[51] Int. Cl.[5] ..... H01H 3/20

[52] U.S. Cl. ..... 200/331; 74/544

[58] Field of Search ..... 200/331; 74/544; 403/73, 119, 65

[56] References Cited

U.S. PATENT DOCUMENTS

| | | | |
|---|---|---|---|
| 3,121,778 | 2/1964 | Sander et al. | 200/331 |
| 3,142,744 | 7/1964 | Keck | 74/544 |
| 3,175,420 | 3/1965 | Craig | 200/331 |
| 3,581,037 | 5/1971 | Schiffelbein | 200/331 |
| 3,722,319 | 3/1973 | Reznik et al. | 200/331 |
| 4,256,943 | 3/1981 | Whitlock | 200/331 |
| 4,419,556 | 12/1983 | Hare | 200/331 |
| 4,507,831 | 4/1985 | McClure | 74/590 |

*Primary Examiner*—Henry J. Recla
*Assistant Examiner*—Glenn T. Barrett
*Attorney, Agent, or Firm*—Paul H. Gallagher

[57] ABSTRACT

A handle, with a transverse hole through the upper end; a connector made of wire formed in a loop; a gripper consisting of a tubular element, with limited yieldability and having a transverse hole therethrough at one end; the elements of the connector are fitted in the holes in the handle and gripper.

3 Claims, 2 Drawing Sheets

EXAGERATED

SWITCH ACTUATING EXTENSION

FIELD OF THE INVENTION

The invention resides in the field of actuating wall switches, from the standpoint of facilitating their actuation, by small children who cannot normally reach such a switch, and by the handicapped who may have difficulty in reaching the switch. The invention is embodied in a device that is applied to a switch for operating it.

OBJECTS OF THE INVENTION

A broad object of the invention is to provide a switch actuating extension that is extremely simple in design, and in the materials used in its construction, and in fabricating those materials into the final device.

Another object is to provide a device of the foregoing character that, because of its extreme simplicity, is easily applied to a switch and removed therefrom, and the device is easily manipulated to actuate the switch.

Another object is to provide a device of the foregoing character that is made up of parts that are already known and readily accessible, and in inexpensive, and from which the final device is fabricated with a very small number of simple steps.

Still another object is to provide a device of the foregoing character that will withstand relative rough usage, as may be occasioned by a small child, and the handicapped.

An additional object is to provide a device of the foregoing character which includes a gripper as one of its components, the grippers being of different sizes in devices made up of otherwise similar elements, all of which are of materials that are known and on the market, whereby a plurality of devices can easily be produced for respectively different sizes of switches

Figure 1:
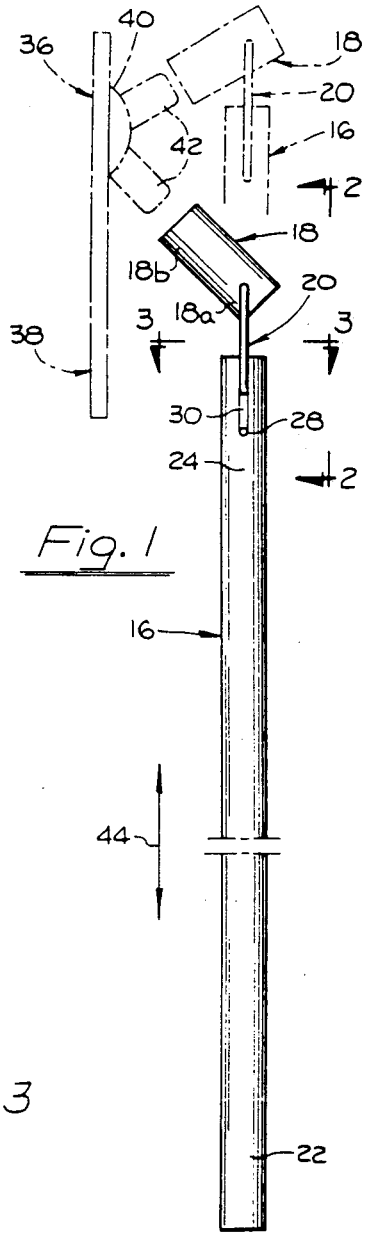
FIG. 1 is a side view of the device of the invention shown in association with a switch with which it is to be used, the latter being shown in dot-dash lines.
Figure 3:
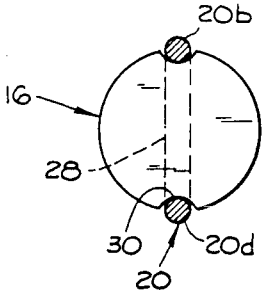
FIG. 3 is a view taken at line 3—3 of FIG. 1.

Referring in detail to the drawings, attention is directed first to FIG. 1 showing the device of the invention, the switch actuating extension, in its entirety. The device includes three main components, namely, a handle 16, a gripper 18, and a connector 20.

The handle may be of any suitable material, such as plastic, and as referred to again hereinbelow, is of suitable length, such as 12"long. The handle 16 may be cylindrical in its basic form, and is preferably a rod. For convenience, the handle 16 (FIG. 1) will be referred as having a lower end 22 and an upper end 24, the device being normally in the position shown in FIG. 1 when in use, but of course it is usable in other positions. The handle has certain conformations in its upper end as referred to hereinbelow.

The gripper 18 is a simple cylindrical tube of flexible and stretchable material, such as a suitable plastic and may be in the neighborhood of 1"long.

Figure 2:
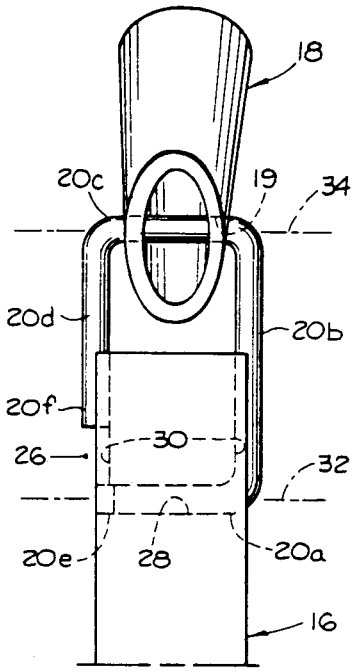
FIG. 2 is a view taken at line 2—2 of FIG. 1.

The connector 20 is in the form of a single, integral piece of wire, shaped into a generally looped form as shown in FIG. 2 and referred to hereinbelow. The connector has a rear transverse element **20*a*, a first side piece 20*b*, a front transverse element 20*c*, and a second side piece 20*d*. The rear transverse element 20*a* has a free and unconnected end 20*e*, and the second side piece 20*d* has a free and unconnected end 20*f*. The side piece 20*d* is of such length as to leave a space 26** between the free and unconnected ends referred to. The wire from which the connector is fabricated is relatively rigid although with a limited degree of yieldability and resilience as referred to hereinbelow.

The gripper 18 may also be referred to as having a lower end **18*a* and an upper end 18*b*, so designated according to the position usually assumed by the gripper. The gripper has diametrically aligned holes 25** therethrough, at the lower end, as will be referred to again hereinbelow.

The handle 16 has a transverse hole 28 extending therethrough adjacent to and spaced from the upper end surface of the handle. Leading from the hole 28 on opposite sides of the handle are longitudinal grooves 30 extending through the end surface of the handle at the upper end of the handle.

FIG. 2 indicates an axis 32 through the hole 28 and the corresponding end of the connector, when the latter is in the hole, and an axis 34 through the hole 19, and the corresponding element of the connector, when the latter is in that hole.

The switch referred to above, with which the device is to be used, is indicated at 36 in FIG. 1, and as shown here includes an escutcheon plate 38, a movable member 40, the latter having an actuating lever 42 extending outwardly from the wall in which the switch is mounted. The movable member 40 in the actuation of the switch, is moved to and between the two positions indicated in FIG. 1, and the device when applied to the switch is movable vertically as indicated by the double headed arrow 44. The device is applied to the switch by fitting the gripper 18 on the lever 42 as described more fully hereinbelow.

Figure 4:
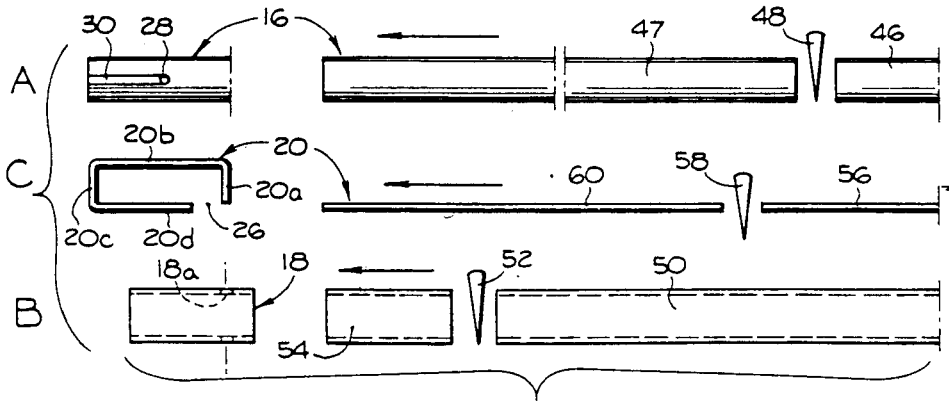
FIG. 4 is a layout of materials used in forming the components of the device.

Attention is directed to the fabrication and formation of the three principal parts of the device, namely, the handle 16, gripper 18, and connector 20, and attention is directed particularly to FIG. 4. As stated hereinabove, a great advantage is that it is of extreme simplicity, each of the components individually being of simple construction, and in fact each of the components is basically a piece cut off from an aggregate supply that is uniform throughout its length, and each piece thereby being uniform throughout its own length, before fabrication following the cut off step. In FIG. 4 the handle, the gripper, and the connector are represented at positions A, B, C. In the case of the handle, a continuous supply or aggregate is provided as indicated at 46 which in this case is a cylindrical piece of indeterminate length, that is, it may be of any great length sufficient for cutting off a large number of individual pieces, each to form a handle. Such an individual piece as shown at 47 is cut off from the aggregate 46 by knife means 48 and after that first cutting off step, and thereafter the hole 28 and grooves 30 are formed therein.

In the case of the gripper 18, at position B, a continuous supply, or aggregate of the material is provided at 50, of indeterminate length, and by knife means 42 a length 54 is cut off, and in the latter, the diametrical hole 18*a* is formed.

In the case of the connector, at position C, similar steps are followed, namely, a continuous length, or aggregate 56, of indeterminate length is provided, and by utilizing knife means 58, a piece 60 is cut therefrom. After cutting off the piece 60, this piece is shaped into the loop form shown at the left (see also FIG. 2) which now includes the elements referred to above and described in connection with FIG. 2.

Figure 5:
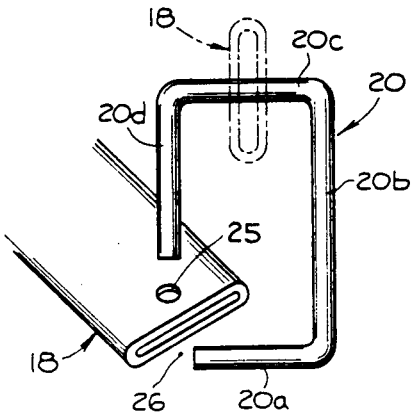
FIG. 5 is a view of the connector and gripper in a position preparatory to fitting them together.
Figure 6:
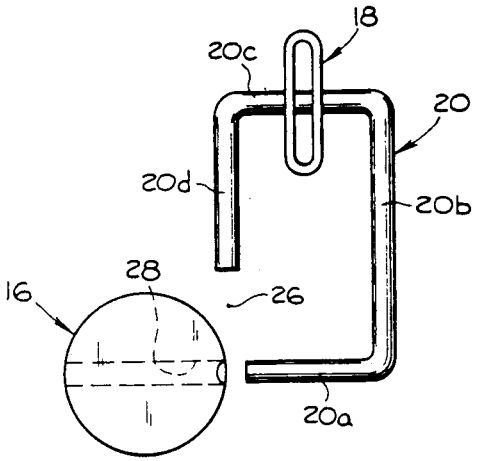
FIG. 6 is a view of the connector and the gripper after the gripper is mounted on the connector, and with the connector poised for connection with the handle.
Figure 7:
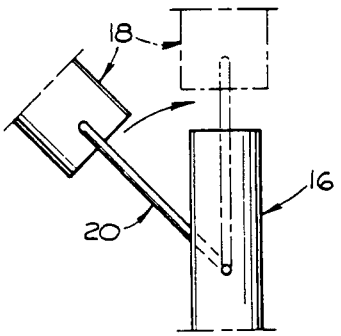
FIG. 7 is a view showing a step following that of FIG. 6.

In each, the aggregate material is uniform throughout its length. The components or parts, after being formed as referred to in connection with FIG. 4, are then connected together, as represented in FIGS. 5–7. To connect them together, the gripper 18 is flattened as indicated in FIG. 5 with the holes 25 in register, and fitted to the connector by inserting the gripper into the space 26 and inserting the second side piece 20*d* through the holes, and then sliding the gripper along that piece, and onto the front transverse element 20*c*. Following this, the connector is applied to the handle 16 as represented in FIG. 6, by inserting the rear transverse element 20*a* through the transverse hole 28 in the handle. In this position the connector may be positioned transverse to the handle as shown in FIG. 6 and then the connector, with the gripper, is swung as indicated in FIG. 7, into a longitudinal position relative to the handle shown in dot-dash lines.

Upon swinging the gripper (as in FIG. 7), the side elements 20*b*, 20*d* fall into the grooves 30, and the various elements are so dimensioned that these elements so grip the handle as to hold the connector and the gripper in the desired position (FIGS. 1, 2) which is referred to as an operating position. The wire of the connector is of strong spring steel, and as noted, possesses a limited degree of yieldability and resilience, enabling the side elements to ride over the high points on the handle and fall into the grooves. In the latter step, the side element 20*d* so flexes or bends, and the first side elements 20*b* may flex or bend also, or it may be that the connector shifts bodily, partially pulling the element 20*a* out of the hole in the handle, in the action of the side elements falling into the grooves. In any case the side elements snugly grip the handle to hold the connector and gripper in the desired position.

Figure 8:
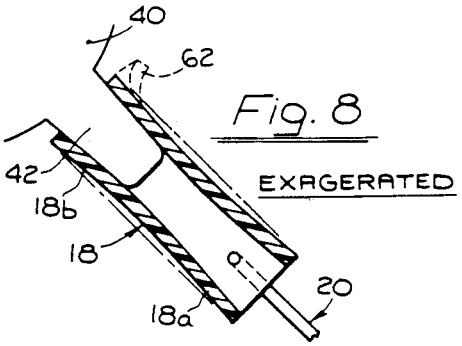
FIG. 8 is a sectional view of the gripper applied to the switch and showing a portion of the connector.

FIG. 8 shows the details of applying the device to the switch. The lever 42 may be polygonal in cross section, and in many instances it is tapered, and the gripper 18 is so applied by telescoping it over the lever as shown in FIG. 8. The gripper as indicated above is stretchable, and when it pulls away from the lever, it stretches and is reduced in diameter, and thereby grips the lever more tightly, in an action similar to what is generally known as the "Chinese Clutch." The gripper thus securely grips the switch lever and despite relatively rough usage, the gripper is not pulled off the switch lever. To remove the gripper from the lever, when desired, the upper end is peeled or pulled out as indicated at 62, to loosen it from the lever.

Figure 9:
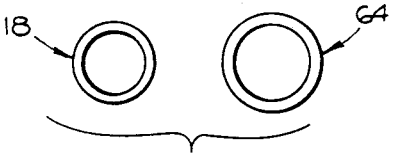
FIG. 9 is an end view of grippers of different sizes.

Switches such as 36 are of various sizes, and specifically the levers 42 are of corresponding different sizes, and to accommodate the different sizes of levers, grippers of different dimensions may be provided as indicated in FIG. 9. In this figure the gripper 18 is shown of a first size, and another gripper 64 of different diameter is shown, the latter being of a suitable length, which may be the same length as that of the gripper 18.

Figure 10:
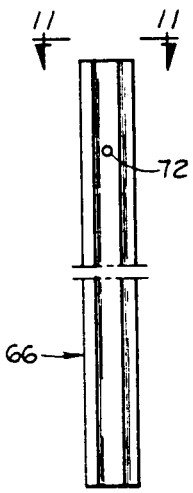
FIG. 10 is a side view of an alternate form of handle.
Figure 11:
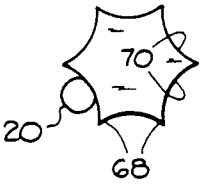
FIG. 11 is an end view, taken at line 11—11 of FIG. 10.

While the handle 16 as described above may be made of cylindrical material it is also possible to make the handle from another kind of material as represented in FIGS. 10 and 11. In this case the handle 66 is of star shape (see cross section) as indicated in FIG. 11, having ribs 68 forming grooves 70 therebetween. In this case the grooves 70 serve the same purpose as the grooves 30 (FIGS. 1, 2) and therefore the step of forming the grooves 30 is eliminated in this case. In the fabrication of the handle 66, it need merely be provided with a hole 72 corresponding to the hole 28 (FIGS. 1, 2), not requiring further fabrication. Such material as shown in FIGS. 10 and 11 of indeterminate length, is a stock item presently found on the market.

Figure 12:
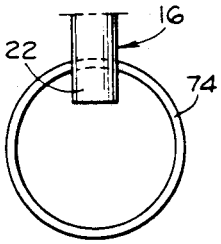
FIG. 12 is a fragmentary view of the lower end of the handle showing a ring therein.
Figure 13:
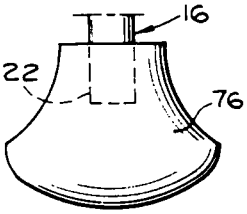
FIG. 13 is a fragmentary view of the lower end of the handle, showing a manipulating knob thereon.

If desired the handle may be provided with a ring 74 (FIG. 12) at its lower end which may serve the dual purpose of providing an enlargement to facilitate handling the device, and as a means to hang up and store the device. Also if desired a knob 76 (FIG. 13) may be utilized, instead of the ring 74, to form an enlargement to facilitate handling the device, in holding it by the hand.

In the case of using the device for a small child to reach the switch, it is pointed out that the switch is normally above the child's reach, and the handle 16 may be of a corresponding length. Additionally, the length may be such as to enable the use of it by only the large ones of the children, not those smaller than a certain size.

The advantage of the device for the handicapped is now also evident.

A great advantage of the invention is the use of known materials in forming the device, and the fact that the materials are of uniform shapes, and now known. In the case of the different size grippers, (18, 64, FIG. 9), this length may be substantially identical.

I claim:

1. An actuating extension for a switch that is complete in itself and installed in a structure, and having a movable element for actuating the switch that is exposed, when the switch is so installed, for manual manipulation for so actuating the switch, and the switch being fully actuatable without the use of this actuating extension, wherein, the actuating extension is complete in itself, being made up of components separate and apart from the switch, the actuating extension being made up of, three components separate from each other, namely, a handle, a gripper, and a connector, each the handle, the gripper, and the connector, being constituted by a piece cut from aggregate material of indeterminate length and uniform throughout its length, the handle being elongated and having an upper end, the gripper being tubular in shape of flexible, stretchable material, and adapted to have an upper end thereof telescopically fitted over said movable switch element and normally held thereon by friction, and having a transverse hole therethrough at a lower end, and the connector having a straight front transverse element detachably extended through the hole in the gripper and a straight rear transverse element detachably extended into, and nearly but not entirely through, a hole in the upper end of the handle, the connector having a side element releasably engaging the handle, and the connector being thereby normally held in a fixed position on the handle and the gripper being swingable on said front transverse element and thereby on the axis of that element which is transverse to the longitudinal axis of the handle, that transverse axis being at a position spaced from the upper end of the handle.

2. An actuating extension according to claim 1, wherein, the handle has longitudinal surface ribs provided in the aggregate material, forming grooves between the ribs, said side element is one of a pair of side elements of the connector, and said side elements are releasably positioned in the grooves when the connector is in operating position and releasably hold the connector in its said fixed position.

3. A plurality of switch actuating extensions according to claim 1 wherein, in all, the handles and connectors are of the same size, and the grippers are of respectively different sizes.

* * * * *